US007398760B2

(12) United States Patent
Kondo

(10) Patent No.: US 7,398,760 B2
(45) Date of Patent: Jul. 15, 2008

(54) INTAKE AIR CONTROL APPARATUS FOR MOTOR CYCLE

(75) Inventor: Yasushi Kondo, Kawasaki (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/798,209

(22) Filed: May 11, 2007

(65) Prior Publication Data

US 2007/0272205 A1 Nov. 29, 2007

(30) Foreign Application Priority Data

May 11, 2006 (JP) ..... 2006-132133

(51) Int. Cl.
*F02D 9/02* (2006.01)

(52) U.S. Cl. ..... 123/336; 123/399; 123/400; 123/442

(58) Field of Classification Search ..... 123/336, 123/399, 400, 442; 180/219
See application file for complete search history.

(56) References Cited

U.S. PATENT DOCUMENTS 6,047,680 A * 4/2000 Shimura et al. ..... 123/336
6,581,567 B2 6/2003 Deguchi
7,124,736 B2 * 10/2006 Kondo et al. ..... 123/400

FOREIGN PATENT DOCUMENTS

JP 2005-090471 7/2005

* cited by examiner

*Primary Examiner*—T. M Argenbright
(74) *Attorney, Agent, or Firm*—Bacon & Thomas, PLLC

(57) ABSTRACT

In order to protect a rotating portion of an intermediate link lever support pin, an intake air control apparatus provided with main and sub throttle valves is structured such that a wire bracket (6) supporting valve opening and closing wires (Wa, Wb) is screwed to an outer end surface (1*a*) at a throttle drum side of a throttle body (1), an intermediate link lever support pin (23) is provided toward the throttle body (1) side on an inner end surface (6*d*) facing to the throttle body (1) of the wire bracket (6), an intermediate link lever (20) rotatably borne to the intermediate link lever support pin (23) is arranged at the throttle body (1) side from the inner end surface (6*d*), and a rotating portion (R) of the intermediate link lever support pin (23) and the intermediate link lever (20) is arranged to face to the inner end surface (6*d*).

1 Claim, 4 Drawing Sheets

INTAKE AIR CONTROL APPARATUS FOR MOTOR CYCLE

BACKGROUND OF THE INVENTION

1. Field of the Invention

The present invention relates to an intake air control apparatus provided with a fuel injection valve injecting fuel toward an internal combustion engine as well as controlling an amount of air toward the engine, and particularly relates to an intake air control apparatus for a motor cycle provided with a main throttle valve opening and closing an intake passage working with an accelerator grip operated by a driver and attached to a main throttle shaft, and a sub throttle valve opening and closing an intake passage at an upstream side from the main throttle valve on the basis of an operation of a motor driven in correspondence to an operating state of the engine and attached to a sub throttle shaft, in the intake passage provided through an inner portion of a throttle body.

2. Description of the Conventional Art

In the intake air control apparatus of the internal combustion engine mentioned above, at a starting time when an engine atmosphere temperature is cold (called as a cold starting time), an increase of an amount of air toward the engine is executed by making an opening degree of the main throttle valve open toward a first idle opening degree from an idling opening degree, and the sub throttle valve is made open to an approximately full-open state by a motor at a time of making the main throttle valve open to the first idle opening degree from the idling opening degree, whereby the opening degree of the main throttle valve is mechanically made open to the first idle opening degree from the idle opening degree on the basis of the opening motion of the sub throttle valve.

The conventional art mentioned above is shown in Japanese Unexamined Patent Publication No. 2005-90471.

A description will be given of the conventional art with reference to FIGS. 3 and 4.

FIG. 3 is a front view and FIG. 4 is a right side view of FIG. 3.

Reference numeral 10 denotes a throttle body in which an intake passage 11 is provided through an inner portion. In the intake passage 11, there is arranged a main throttle valve 13 attached to a main throttle shaft 12 rotatably borne to the throttle body 10. One end of the main throttle shaft 12 is arranged so as to protrude in a side direction (a left side in FIG. 4) from the throttle body 10, and a throttle drum 14 is arranged at the protruding end portion of the main throttle shaft 12 so as to be screwed. Further, a valve opening wire Wa and a valve closing wire Wb are locked to an accelerator grip G at one ends thereof, and the other ends of the valve opening wire Wa and the valve closing wire Wb are locked to the throttle drum 14. The vale opening wire Wa rotates the throttle drum 14 in a counterclockwise direction in FIG. 3 on the basis of a rotation of the accelerator grip in one direction executed by the driver, whereby the main throttle valve 13 opens the intake passage 11. On the other hand, the vale closing wire Wb rotates the throttle drum 14 in a clockwise direction in FIG. 3 on the basis of a rotation of the accelerator grip in the other direction executed by the driver, whereby the main throttle valve 13 closes the intake passage 11.

In the structure mentioned above, the valve opening wire Wa and the valve closing wire Wb are held via regulating tube members Bc and Bd inserted into support holes Ba and Bb formed at an upper end of a wire bracket B by bending, and a flat portion Be of the wire bracket B is screwed fixedly onto an outer end surface 10*a* (a left end surface in FIG. 4) close to the throttle drum 14 of the throttle body 10 by means of a screw C. In this case, the regulating tube members are omitted in FIG. 4.

Further, an opening degree state of the main throttle valve 13 in FIG. 3 indicates an idling opening degree state, and an idling opening degree is regulated by arranging an idle regulating screw D so as to be brought into contact with an idle control arm portion 14*a* formed on the throttle drum 14, and moving forward and backward the idle regulating screw D by screwing.

Reference numeral 15 denotes a sub throttle valve arranged in an intake passage 11*a* at an upstream side from the main throttle valve 13. The sub throttle valve 15 is attached to a sub throttle shaft 16 rotatably borne to the throttle body 10.

One end of the sub throttle shaft 16 is arranged so as to protrude to a left side in FIG. 4 from the throttle body 10, and a cam lever 17 provided with a cam surface 17*a* is arranged at the left protruding end portion of the sub throttle shaft 16 by screwing. In this case, a motor M rotationally driven in correspondence to an engine operating state is connected to the other end (a right end portion in FIG. 4) of the sub throttle shaft 16, whereby the sub throttle shaft 16 is electrically driven by the motor.

Reference symbol L denotes an intermediate link lever for transmitting a rotation of the cam lever 17 to the throttle drum 14. (In other words, the rotation of the sub throttle valve 15 is transmitted to the main throttle valve 13.)

The intermediate link lever L is arranged so as to be rotatably borne to an intermediate link lever support pin P provided toward an outer side (a left side in FIG. 4) so as to rise on an outer end surface Bg (a left end surface in FIG. 4 in a side facing to the throttle drum 14) of the flat portion Be of the wire bracket B via a collar E. Further, on the intermediate link lever L, there is arranged a roller T facing to the cam surface 17*a* of the cam lever 17, and there is attached a first idle regulating screw F facing to a first idle control arm portion 14*b* of the throttle drum 14.

In this case, at a time of the idle opening degree of the main throttle valve 13 in FIG. 3, a leading end of the first idle regulating screw F is not brought into contact with the first idle control arm portion 14*b* of the throttle drum 14.

In accordance with the intake air control apparatus mentioned above, at starting times under the engine atmosphere temperature being a room temperature and a high temperature, since the sub throttle valve 15 is not made open to the full-open state by the motor M, and the cam surface 17*a* of the cam lever 17 is not brought into contact with the roller T of the intermediate link lever L, the intermediate link lever L does not rotate, and the first idle regulating screw F is not brought into contact with the first idle control arm portion 14*b* of the throttle drum 14. Accordingly, the main throttle valve 13 is held to a predetermined idling opening degree, and the engine start is executed at the room temperature time and the high temperature time.

On the other hand, at a starting time under the engine atmosphere temperature being cold, the sub throttle shaft 16 is electrically rotationally operated by the motor M, and the sub throttle valve 15 is made open to an approximately full-open state. In accordance with the rotation of the sub throttle shaft mentioned above, the cam lever 17 is synchronously rotated largely in an opening direction (a counterclockwise direction in FIG. 3) of the sub throttle valve 15, whereby the cam surface 17*a* of the cam lever 17 is brought into contact with the roller T so as to synchronously rotate the intermediate link lever L in the clockwise direction.

Further, in accordance with the rotation in the clockwise direction of the intermediate link lever L, the first idle regulating screw F is brought into contact with the idle control arm portion 14*a* of the throttle drum 14 so as to rotate the throttle drum 14 in the counterclockwise direction, whereby the main throttle valve 13 is automatically made open toward the first idle opening degree regardless of the operation of the accelerator grip.

Accordingly, since the main throttle valve 13 is automatically made open to the first idle opening degree via the sub throttle shaft 16, the cam lever 17, the intermediate link lever L and the like on the basis of the rotational drive of the motor M at the cold starting time of the engine, it is possible to increase an amount of air heading for the engine, whereby it is possible to execute an improved cold start of the engine.

SUMMARY OF THE INVENTION

Problems to be Solved

In accordance with the conventional intake air control apparatus mentioned above, the flat portion of the wire bracket is arranged on the outer end surface of the throttle body by screwing, and the intermediate link lever is rotatably arranged around the intermediate link lever support pin existing on the outer end surface of the wire bracket and arranged so as to protrude toward the outer side via the collar.

In accordance with the structure mentioned above, the rotating portion of the intermediate link lever, specifically, the rotating portion between the intermediate link lever support pin and the collar is arranged so as to be exposed toward the outer side from the outer end surface of the wire bracket, and this structure is not preferable in view of the following points at a time of mounting the intake air control apparatus on the motor cycle.

The rotating portion constituted by the intermediate link lever support pin and the collar is arranged so as to be exposed toward the outer side, and is not provided with a protection member covering the rotating portion. Accordingly, particularly at a time of being mounted to the motor cycle, when a foreign material comes into collision with the rotating portion or at a time of falling down, external force is applied to the rotating portion, and there is a risk that a smooth operation of the rotating portion is obstructed. On the other hand, since the rotation of the intermediate link lever mentioned above is controlled by the motor which moves the cam lever and the sub throttle shaft by screwing, an initial rotation control by the motor is deteriorated in the case that the operation of the rotating portion becomes unsmooth as mentioned above. In this case, there is considered an increase of the rotating force with respect to the intermediate link lever by increasing an output of the motor, however, this structure causes an enlargement in size of the motor, and an increase of an electric power consumption. Accordingly, particularly in the motor cycle, it is hard to employ this structure.

Further, at a time of carrying the intake air control apparatus, or at a time of assembling the intake air control apparatus to the motor cycle, it is necessary to carefully execute the work in such a manner as to prevent the external force from being applied to the intermediate link lever support pin.

Further, almost whole of the intermediate link lever are arranged so as to be exposed to the outer side. In accordance with this structure, the external force tends to be applied to the intermediate link lever and a deformation of the intermediate link lever tends to be generated. In addition, the intermediate link lever is visible from the outer side, and it is impossible to neatly arrange the intake air control apparatus.

This is a peculiar problem to the motor cycle.

Means for Solving Problem

An intake air control apparatus in accordance with the present invention is made by taking the problem mentioned above into consideration, and an object of the present invention is to provide an intake air control apparatus for a motor cycle which can securely control a rotation of an intermediate link lever on the basis of a motor drive while stably maintaining a rotation of a rotating portion between an intermediate link lever support pin and a collar integrally formed with the intermediate link lever over a long period of time, whereby it is possible to securely execute a cold start of the engine, the intake air control apparatus being particularly preferable for the motor cycle.

In order to achieve the object mentioned above, in accordance with the present invention, there is provided an intake air control apparatus of an internal combustion engine for a motor cycle, comprising a main throttle valve attached to a main throttle shaft operated by a driver for opening and closing the intake passage provided through an inner portion of a throttle body; a sub throttle valve arranged within an intake passage at an upstream side from the main throttle valve, and attached to a sub throttle shaft operated by a motor driven in correspondence to an operating state of an engine for opening and closing an intake passage; a wire bracket holding a valve opening wire and a valve closing wire coupling a throttle drum arranged at an end portion of the main throttle shaft and an accelerator grip, and attached to the throttle body; an idle regulating screw arranged so as to be brought into contact with an idle control arm portion of the throttle drum; and an intermediate link lever arranged so as to face to a cam lever arranged at an end portion of the sub throttle shaft and arranged so as to face to a first idle control arm portion of the throttle drum; a rotation of the cam lever being transmitted to the throttle drum via the intermediate link lever so as to open the main throttle valve at a fixed opening degree toward a first idle opening degree, wherein the wire bracket is arranged on an outer end surface at the throttle drum side of the throttle body by screwing, and the intermediate link lever support pin is arranged on an inner end surface facing to the throttle body of the wire bracket so as to rise toward the throttle body side, and wherein the intermediate link lever rotatably borne by the intermediate link lever support pin is arranged at the throttle body side from the inner end surface of the wire bracket, and a rotating portion between the intermediate link lever support pin and the intermediate link lever is arranged so as to face to the inner end surface of the wire bracket.

Effect of the Invention

The wire bracket is arranged on the throttle drum side outer end surface formed at the throttle drum side from the throttle body by screwing, and the intermediate link lever support pin is provided so as to rise on the inner end surface facing to the throttle body of the wire bracket toward the throttle body side. Further, the intermediate link lever is rotatably borne by the intermediate link lever support pin, and the intermediate link lever is arranged toward the throttle body side from the inner end surface facing to the throttle body of the wire bracket.

In accordance with the structure mentioned above, since the rotating portion between the intermediate link lever support pin and the intermediate link lever is arranged at the throttle body side from the inner end surface facing to the throttle body of the wire bracket, the outer side of the rotating portion is protected by the wire bracket at a time of being mounted to the motor cycle.

In accordance with the structure mentioned above, it is possible to prevent deformation of the rotating portion at a time when the motor cycle is fallen down as well as it is possible to prevent collision of a foreign material such as a stone or the like with the rotating portion. It is possible to well maintain the rotation of the intermediate link lever around the intermediate link lever support pin over a long period of time, it is possible to stably execute an initial rotation control of the intermediate link lever by the motor, and it is possible to execute an improved low temperature start particularly in the motor cycle.

Further, at a time of carrying the intake air control apparatus and at a time of assembling the intake air control apparatus to the motor cycle, any particular consideration is not necessary with respect to the rotating portion, and it is possible to improve a workability.

Further, since the wire bracket is arranged at the outer side of the intermediate link lever, and it is possible to make the intermediate link lever hard to be directly visible from the outer side, it is possible to neatly arrange an outer appearance shape of the intake air control apparatus, and it is possible to improve a commodity property.

Further, since the intermediate link lever is arranged at the throttle body side at the inner side from the inner end surface facing to the throttle body of the wire bracket, it is possible to move the throttle drum to the throttle body side at that degree, whereby it is possible to shorten an overall width of the intake air control apparatus. Accordingly, it is possible to improve a mounting property to the motor cycle limited to a narrow housing space.

DETAILED DESCRIPTION OF PREFERRED EMBODIMENT

Figure 1:
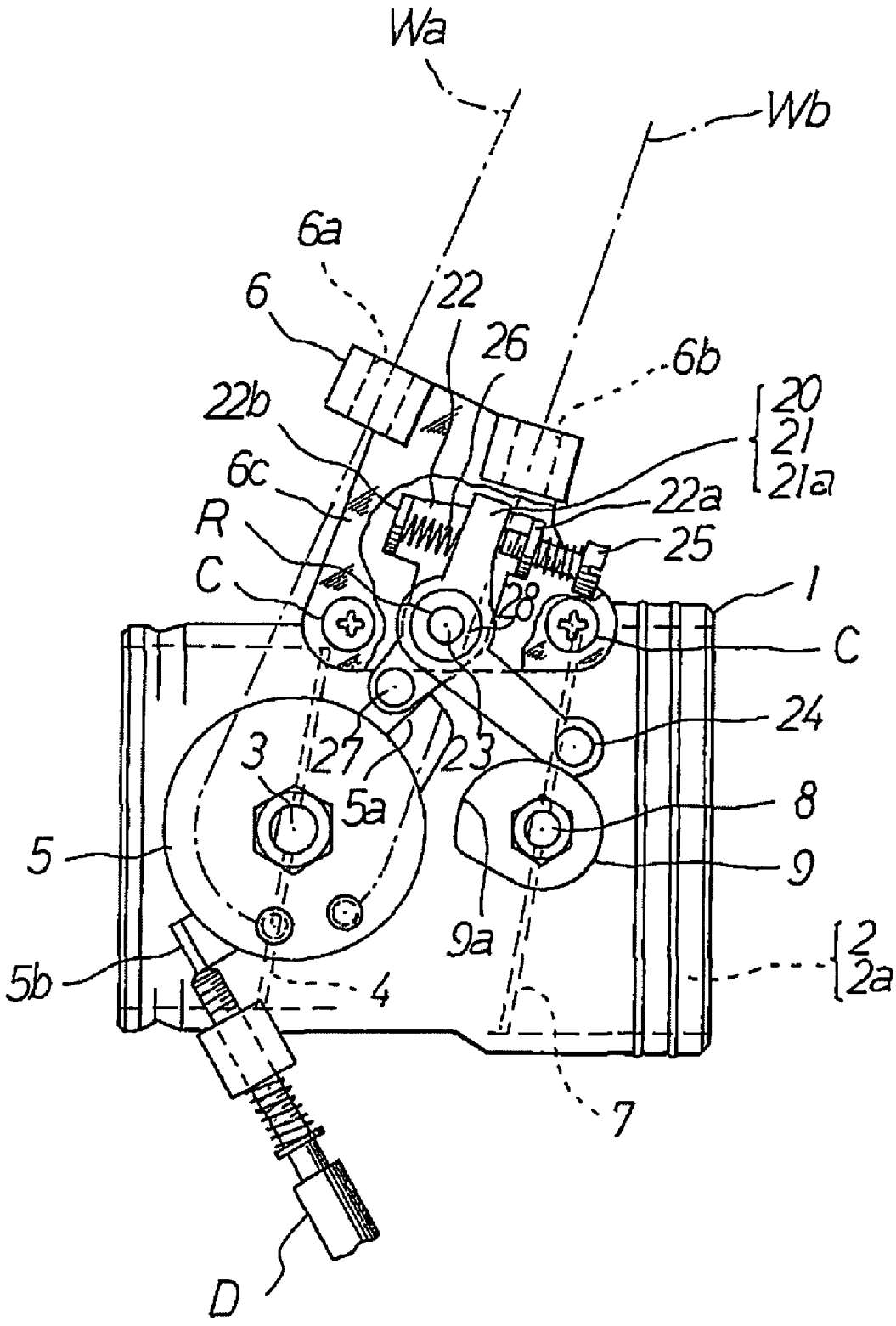
FIG. 1 is a front view showing an embodiment of an intake air control apparatus for a motor cycle in accordance with the present invention.
Figure 2:
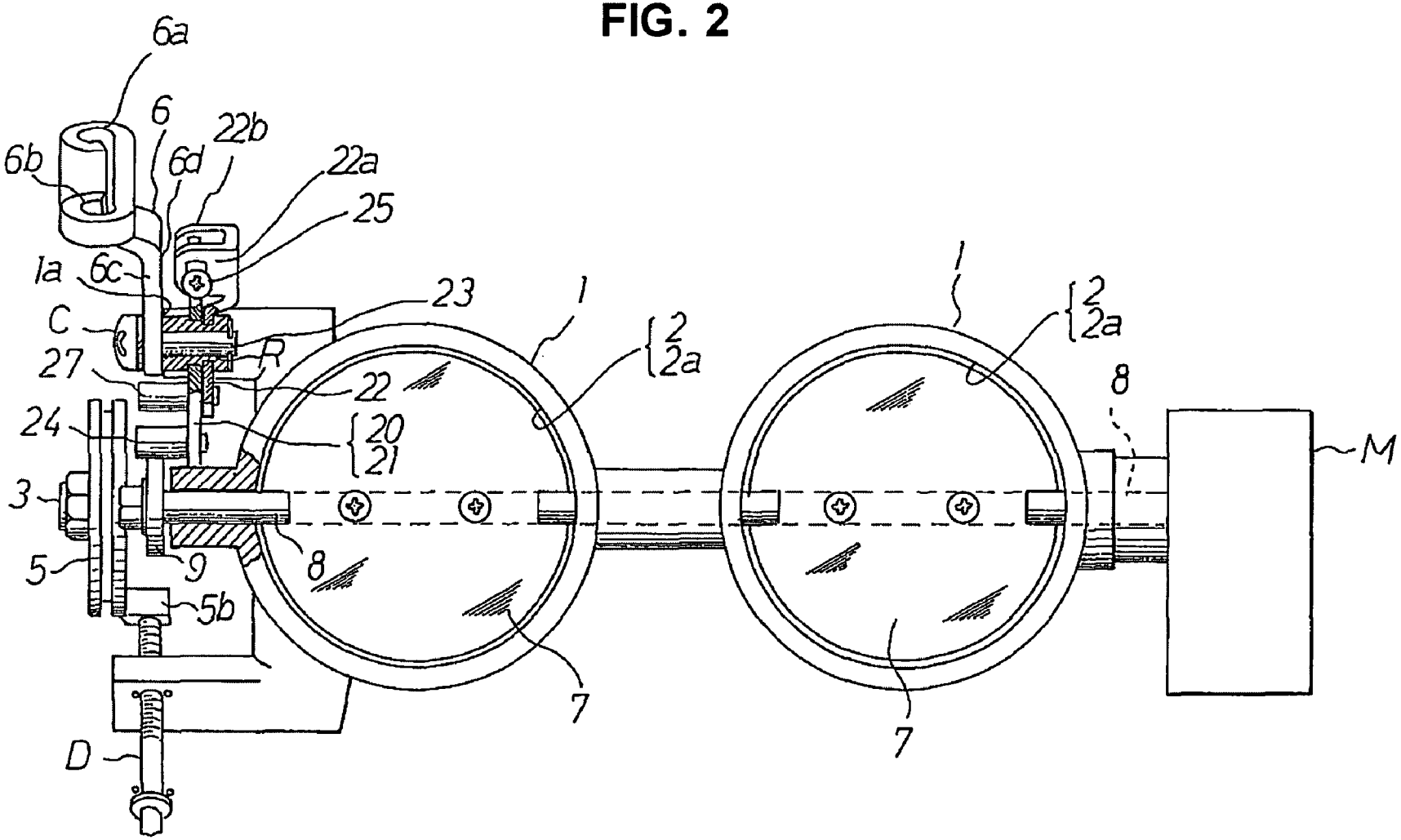
FIG. 2 is a right side view of FIG. 1.
Figure 3:
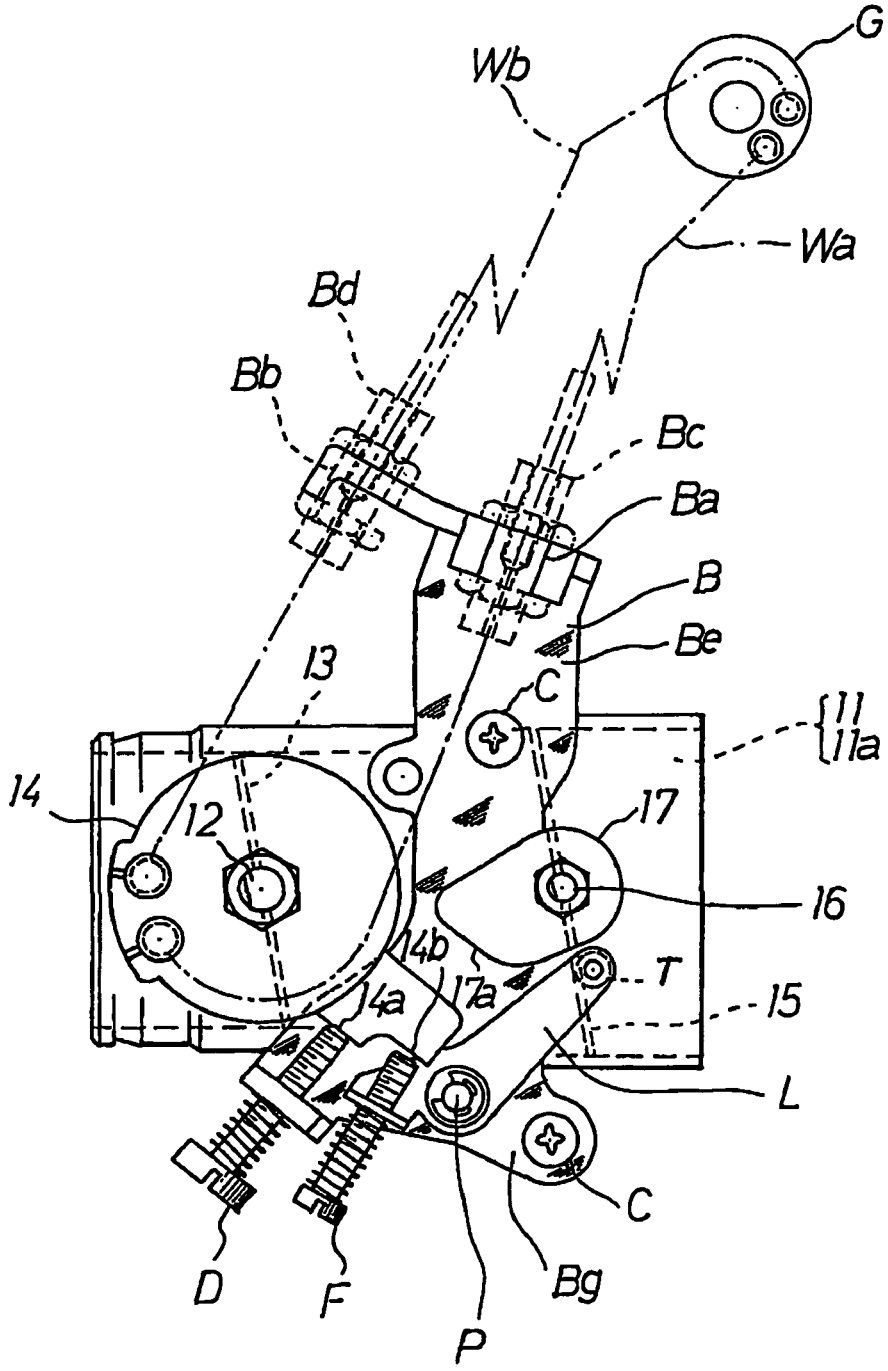
FIG. 3 PRIOR ART
FIG. 3 is a front view of a conventional intake air control apparatus.

A description will be given below of an embodiment of an intake air control apparatus for a motor cycle in accordance with the present invention with reference to the accompanying drawings. FIG. 1 is a front view and FIG. 2 is a right side view of FIG. 1.

Reference numeral 1 denotes a throttle body in which an intake passage 2 is provided through an inner portion thereof. In the intake passage 2, there is arranged a main throttle valve 4 attached to a main throttle shaft 3 rotatably borne to the throttle body 1. One end of the main throttle shaft 3 is arranged so as to protrude to a side direction (a left side in FIG. 2) from the throttle body 1, and a throttle drum 5 is arranged at a protruding end portion of the main throttle shaft 3 so as to be screwed. Further, a valve opening wire Wa and a valve closing wire Wb are locked to an accelerator grip (not shown) at one ends thereof, and the other ends of the valve opening wire Wa and the valve closing wire Wb are locked to the throttle drum 5. The vale opening wire Wa rotates the throttle drum 5 in a clockwise direction in FIG. 1 on the basis of a rotation of the accelerator grip in one direction executed by the driver, whereby the main throttle valve 4 opens the intake passage 2. On the other hand, the vale closing wire Wb rotates the throttle drum 5 in a counterclockwise direction in FIG. 2 on the basis of a rotation of the accelerator grip in the other direction executed by the driver, whereby the main throttle valve 4 closes the intake passage 2.

In the structure mentioned above, the valve opening wire Wa and the valve closing wire Wb are held via regulating tube members (not shown) inserted into support holes 6*a* and 6*b* formed at an upper end of a wire bracket 6 by bending, and a flat portion 6*c* of the wire bracket 6 is screwed fixedly onto an outer end surface 1*a* (a left end surface in FIG. 2) at the throttle drum 5 side of the throttle body 1 by means of a screw C.

In this case, the throttle drum is provided with a first idle control arm portion 5*a* and an idle control arm portion 5*b*, an opening degree state of the main throttle valve 4 shown in FIG. 1 indicates an idling opening degree state, and the idling opening degree is regulated by arranging an idle regulating screw D screwed to the throttle body 1 so as to be brought into contact with the idle control arm portion 5*b* of the throttle drum 5, and moving forward and backward the idle regulating screw D by screwing.

Reference numeral 7 denotes a sub throttle valve arranged in an intake passage 2*a* at an upstream side from the main throttle valve 4. The sub throttle valve 7 is attached to a sub throttle shaft 8 rotatably borne to the throttle body 1.

Figure 4:
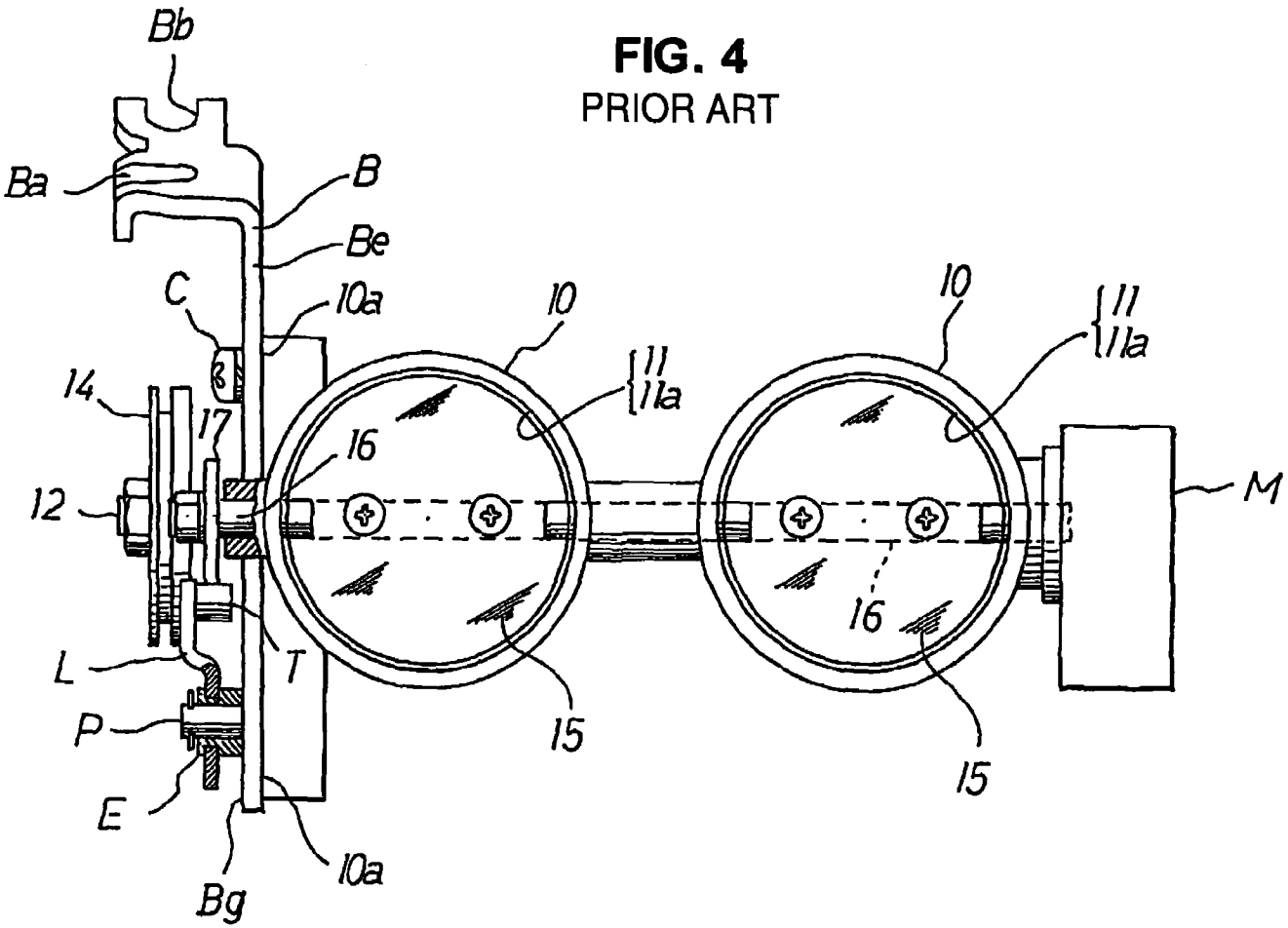
FIG. 4 PRIOR ART
FIG. 4 is a right side view of FIG. 3.

One end of the sub throttle shaft 8 is arranged so as to protrude to a left side in FIG. 2 from the throttle body 1, and a cam lever 9 provided with a cam surface 9*a* is arranged at a left protruding end portion of the sub throttle shaft 8 by screwing. In this case, a motor M rotationally driven in correspondence to an engine operating state is connected to the other end (a right end portion in FIG. 4) of the sub throttle shaft 8, whereby the sub throttle shaft 8 is electrically driven by the motor.

Reference symbol 20 denotes an intermediate link lever for transmitting a rotation of the cam lever 9 to the throttle drum 5. (In other words, the rotation of the sub throttle valve 7 is transmitted to the main throttle valve 4.)

The intermediate link lever 20 is constituted by a first intermediate lever 21 and a second intermediate lever 22, and is rotatably borne to an intermediate link lever support pin mentioned below.

An intermediate link lever support pin 23 is provided so as to rise on an inner end surface 6*d* (a right surface of a flat portion 6*c* in FIG. 2) facing to the throttle body 1 in the flat portion 6*c* of the wire bracket 6.

In other words, the intermediate link lever support pin 23 is arranged so as to protrude toward an inner side from the flat portion 6*c* of the wire bracket 6.

Further, both of the first intermediate lever 21 and the second intermediate lever 22 are attached to a collar 28, and the collar 28 is rotatably borne to the intermediate link lever support pin 23, whereby the first and second intermediate levers 21 and 22 are rotatably borne to the intermediate link lever support pin 23 via the collar 28.

Further, a cylindrical roller 24 is arranged at one end of the first intermediate lever 21, and the roller 24 is arranged so as to face to the cam surface 9*a* of the cam lever 9. (Since the roller 24 faces to the cam surface 9*a*, the roller 24 can be brought into contact with the cam surface 24*a*.) Further, an arm portion 21*a* is formed in the other end of the first intermediate lever 21.

The second intermediate lever 22 is structured such that C-shaped arm portions 22*a* and 22*b* are formed at one end thereof. A leading end of a regulating screw 25 screwed to the C-shaped arm portion 22*a* is arranged so as to be brought into contact with a right surface in FIG. 1 of the arm portion 21*a* at the other end of the first intermediate lever 21, and a coil spring 26 is provided compressedly between the C-shaped arm portion 22*b* and a left surface of the arm portion 21*a* at the other end of the first intermediate lever 21.

Accordingly, the arm portion 21*a* at the other end of the first intermediate lever 21 is pinched by the regulating screw 25 and the coil spring 26 arranged in the C-shaped arm portions 22*a* and 22*b* of the second intermediate lever 22, whereby the first intermediate lever 21 and the second intermediate lever 22 can be synchronously rotated. Further, a cylindrical roller 27 is arranged at the other end of the second intermediate lever 22, and the roller 27 is arranged so as to face to the end surface of the first idle control arm portion 5*a* integrally formed with the throttle drum 5.

In accordance with the structure mentioned above, it is possible to arrange the intermediate link lever support pin 23, the collar 28 and the rotating portion R between the intermediate link lever support pin 23 and the collar 28, and further the arm portion 21*a* of the first intermediate lever 21, and the arm portions 22*a* and 22*b* of the second intermediate lever 22, at the throttle body 1 side from the inner side surface 6*d* facing to the throttle body in the flat portion 6*c* of the wire bracket 6.

In other words, the surface facing to the outer side in the structure mentioned above is covered by the flat portion 6*c* of the wire bracket 6, and the structure mentioned above is not directly exposed to the outer side.

Further, at starting times under the engine atmosphere temperature being a room temperature and a high temperature, since the sub throttle valve 7 is not opened to the full-open state by the motor M, and the cam surface 9*a* of the cam lever 9 is not brought into contact with the roller 24 of the first intermediate lever 21, the first intermediate lever 21 and the second intermediate lever 22 does not rotate, the roller 27 of the second intermediate lever 22 is not brought into contact with the first idle control arm portion 5*a* of the throttle drum 5, the main throttle valve 4 is kept at a predetermined idling opening degree, and it is possible to execute the engine start at the room temperature and the high temperature. On the other hand, at a starting time under the engine atmosphere temperature being a cold temperature, the sub throttle shaft 8 is rotationally operated by the motor M electrically, and the sub throttle valve 7 is opened to an approximately full-open state.

In accordance with the rotation of the sub throttle shaft mentioned above, it is possible to synchronously rotate the cam lever 9 largely in the opening direction of the sub throttle valve 7 (in the clockwise direction in FIG. 1), whereby the cam surface 9*a* of the cam lever 9 is brought into contact with the roller 24 so as to synchronously rotate the first intermediate lever 21 and the second intermediate lever 22 in the counterclockwise direction.

Further, in accordance with the rotation in the counterclockwise direction of the second intermediate lever 22, the roller 27 is brought into contact with the first idle control arm portion 5*a* of the throttle drum 5 so as to rotate the throttle drum 5 in the clockwise direction, whereby the main throttle valve 4 is automatically opened to the first idle opening degree regardless of the operation of the accelerator grip.

Accordingly, at a starting time of the engine under the cold temperature, since the sub throttle shaft 8, the cam lever 9, the intermediate link lever 20 and the throttle drum 5 are synchronously rotated on the basis of the rotational drive of the motor M, and the main throttle valve 4 is automatically opened to the first idle opening degree, it is possible to increase an amount of the air toward the engine, whereby it is possible to execute an improved cold start of the engine.

Further, in accordance with the intake air control apparatus mentioned above, the rotating portion R between the intermediate link lever support pin 23 and the collar 28 to which the intermediate link lever 20 is attached is arranged at the throttle body 1 side from the inner end surface 6*d* facing to the throttle body 1 of the wire bracket 6, whereby at least the rotating portion is covered by the inner end surface 6*d* of the wire bracket 6 so as to inhibit at least the rotating portion from being directly exposed to the outer side (the left side in FIG. 2).

In accordance with the structure mentioned above, since the outer side of the rotating portion R is protected by the flat portion 6*c* of the wire bracket 6, it is possible to prevent a foreign material such as a stone or the like from directly coming into collision with the rotating portion R, and it is possible to prevent the external force from directly acting on the rotating portion R, whereby it is possible to stably transmit the rotation of the cam lever 9 rotated by the motor M to the throttle drum 5 via the intermediate link lever 20 over a long period of time.

Accordingly, it is preferable to employ the intake air control apparatus in the motor cycle in which the intake air control apparatus is arranged so as to be directly exposed to the atmospheric air at a time of being mounted to the engine.

Further, in accordance with the structure mentioned above, since any particular consideration with regard to the rotating portion R is not necessary at a time of carrying the intake air control apparatus before installation to the engine or at a time of installing to the engine, it is possible to easily execute the carrying and assembling works. Further, since the intermediate link lever 20 is arranged at the inner side at the throttle body 1 side from the inner end surface 6*d* of the wire bracket 6, it is possible to move the throttle drum 5 to the inner side at the throttle body 1 side at that degree, whereby it is possible to shorten an overall width of the intake air control apparatus.

What is claimed is:

1. An intake air control apparatus of an internal combustion engine for a motor cycle, comprising:

a main throttle valve attached to a main throttle shaft operated by a driver for opening and closing an intake passage provided through an inner portion of a throttle body;

a sub throttle valve arranged within an intake passage at an upstream side from said main throttle valve, and attached to a sub throttle shaft operated by a motor driven in correspondence to an operating state of an engine for opening and closing said intake passage;

a wire bracket holding a valve opening wire and a valve closing wire coupling a throttle drum arranged at an end portion of the main throttle shaft and an accelerator grip, and attached to the throttle body;

an idle regulating screw arranged so as to be brought into contact with an idle control arm portion of the throttle drum; and an intermediate link lever arranged so as to face to a cam lever arranged at an end portion of the sub throttle shaft and arranged so as to face to a first idle control arm portion of the throttle drum;

a rotation of the cam lever being transmitted to the throttle drum via the intermediate link lever so as to open the main throttle valve at a fixed opening degree toward a first idle opening degree, wherein the wire bracket is arranged on an outer end surface at the throttle drum side of the throttle body by screwing, and the intermediate link lever support pin is arranged on an inner end surface facing to the throttle body of the wire bracket so as to rise toward the throttle body side, and wherein the intermediate link lever rotatably borne by said intermediate link lever support pin is arranged at the throttle body side from the inner end surface of the wire bracket, and a rotating portion between the intermediate link lever support pin and the intermediate link lever is arranged so as to face to the inner end surface of the wire bracket.

* * * * *